US008983833B2

(12) United States Patent
Joshi et al.

(10) Patent No.: US 8,983,833 B2
(45) Date of Patent: Mar. 17, 2015

(54) METHOD AND APPARATUS FOR MASKING WIND NOISE

(75) Inventors: Bijal Joshi, Schaumburg, IL (US); Suat Yeldener, Whitestone, NY (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 1041 days.

(21) Appl. No.: 13/012,062

(22) Filed: Jan. 24, 2011

(65) Prior Publication Data

US 2012/0191447 A1 Jul. 26, 2012

(51) Int. Cl.

| | |
|---|---|
| ***G10L 21/02*** | (2013.01) |
| ***G10L 21/0208*** | (2013.01) |
| ***G10L 21/0216*** | (2013.01) |
| ***H04R 3/00*** | (2006.01) |
| *G10L 21/0232* | (2013.01) |

(52) U.S. Cl.

CPC *H04R 3/00* (2013.01); *G10L 21/02* (2013.01); *G10L 21/0208* (2013.01); *G10L 21/0232* (2013.01); *G10L 2021/02163* (2013.01); *H04R 2410/07* (2013.01)

USPC ..... 704/226; 704/205; 704/233; 381/73.1

(58) Field of Classification Search

CPC . G10L 21/02; G10L 21/0208; G10L 21/0232; G10L 21/0264; G10L 2021/02163

USPC ..... 704/205, 226–227; 381/73.1

See application file for complete search history.

(56) References Cited

U.S. PATENT DOCUMENTS

| | | | | |
|---|---|---|---|---|
| 5,867,581 | A * | 2/1999 | Obara | 381/312 |
| 6,098,038 | A * | 8/2000 | Hermansky et al. | 704/226 |
| 7,844,453 | B2 * | 11/2010 | Hetherington | 704/228 |
| 8,019,103 | B2 * | 9/2011 | Kates | 381/317 |
| 2001/0050987 | A1 * | 12/2001 | Yeap et al. | 379/399.01 |
| 2004/0148160 | A1 * | 7/2004 | Ramabadran | 704/221 |
| 2004/0165736 | A1 * | 8/2004 | Hetherington et al. | 381/94.3 |
| 2004/0167777 | A1 * | 8/2004 | Hetherington et al. | 704/226 |
| 2005/0027520 | A1 * | 2/2005 | Mattila et al. | 704/228 |
| 2005/0159944 | A1 * | 7/2005 | Beerends | 704/225 |
| 2005/0230480 | A1 * | 10/2005 | Kolstad et al. | 235/462.26 |
| 2006/0229869 | A1 * | 10/2006 | Nemer | 704/226 |
| 2007/0030987 | A1 * | 2/2007 | Roeck et al. | 381/312 |
| 2007/0030989 | A1 * | 2/2007 | Kates | 381/317 |
| 2007/0110263 | A1 * | 5/2007 | Brox | 381/110 |
| 2007/0118367 | A1 * | 5/2007 | Dickson et al. | 704/221 |
| 2007/0158426 | A1 * | 7/2007 | Kolstad et al. | 235/462.26 |

(Continued)

FOREIGN PATENT DOCUMENTS

EP 1750483 A1 2/2007

OTHER PUBLICATIONS

Nemer, Elias, and Wilf Leblanc. "Single-microphone wind noise reduction by adaptive postfiltering." Applications of Signal Processing to Audio and Acoustics, 2009. WASPAA'09. IEEE Workshop on. IEEE, Oct. 2009, pp. 177-180.*

(Continued)

*Primary Examiner* — James Wozniak

(57) ABSTRACT

Wind and other noise is suppressed in a signal by adaptively changing characteristics of a filter. The filter characteristics are changed in response to the noise content of the signal over time using a history of noise content. Filter characteristics are changed according to a plurality of reference filters, the characteristics of which are chosen to optimally attenuate or amplify signals in a range of frequencies.

26 Claims, 7 Drawing Sheets

(56) References Cited

U.S. PATENT DOCUMENTS

| | | | | |
|---|---|---|---|---|
| 2008/0004868 | A1* | 1/2008 | Nongpiur et al. | 704/207 |
| 2008/0243496 | A1* | 10/2008 | Wang | 704/226 |
| 2008/0306733 | A1* | 12/2008 | Ozawa | 704/226 |
| 2009/0010453 | A1* | 1/2009 | Zurek et al. | 381/94.5 |
| 2009/0024387 | A1* | 1/2009 | Chandran et al. | 704/226 |
| 2009/0238369 | A1* | 9/2009 | Ramakrishnan et al. | 381/56 |
| 2009/0287485 | A1* | 11/2009 | Glebe | 704/233 |
| 2010/0020986 | A1* | 1/2010 | Nemer et al. | 381/94.1 |
| 2010/0104088 | A1* | 4/2010 | Kato | 379/392.01 |
| 2010/0124341 | A1* | 5/2010 | Kano | 381/94.1 |
| 2010/0211383 | A1* | 8/2010 | Dubbelboer | 704/205 |
| 2011/0081026 | A1* | 4/2011 | Ramakrishnan et al. | 381/94.3 |
| 2011/0106533 | A1* | 5/2011 | Yu | 704/233 |
| 2011/0142256 | A1* | 6/2011 | Lee et al. | 381/94.3 |
| 2012/0128163 | A1* | 5/2012 | Moerkebjerg et al. | 381/23.1 |
| 2012/0148067 | A1* | 6/2012 | Petersen et al. | 381/92 |

OTHER PUBLICATIONS

Kuo, Sen M., and Jyothsna Kunduru. "Multiple reference subband adaptive noise canceler for hands-free cellular phone applications." Journal of the Franklin Institute 333.5 (Sep. 1996), pp. 669-686.*

International Search Report and Written Opinion dated May 11, 2012, from corresponding International Patent Application No. PCT/US2012/022141.

* cited by examiner

METHOD AND APPARATUS FOR MASKING WIND NOISE

BACKGROUND

Wind noise is a serious problem that occurs during telephone conversations that take place outside, in a moving vehicle, or in an otherwise windy environment. Wind noise can cause the listener on the far end of a telephone conversion to be unable to understand or hear the caller's voice.

Wind speed and direction is constantly changing and as a result is very difficult to eliminate from telephone conversations. Conventional wind and/or noise cancelling methods and apparatuses are ineffective. The invention provides an effective method and/or apparatus for masking or eliminating wind noise from a telephone conversation while maintaining audible speech. A method and apparatus for masking, removing or suppressing wind noise would be an improvement over the prior art.

DETAILED DESCRIPTION

Figure 1:
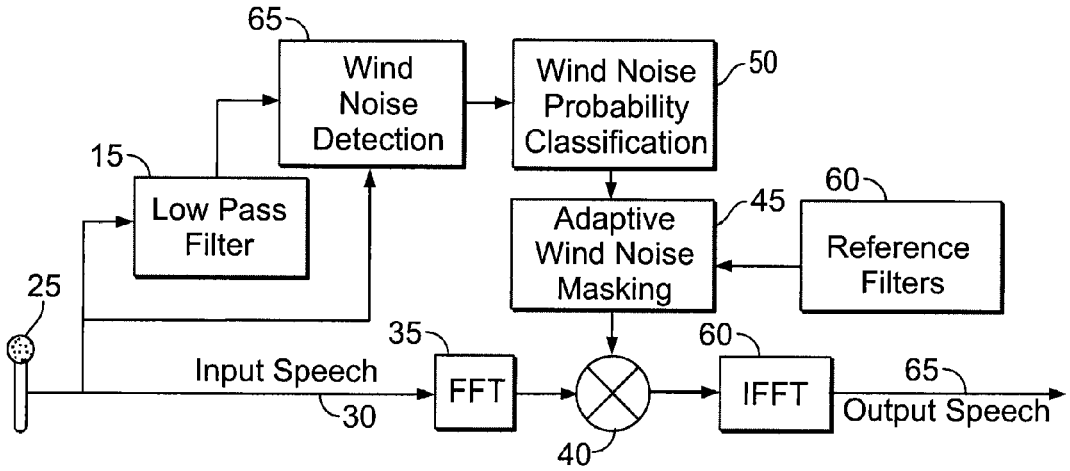
FIG. 1 depicts a block diagram for an adaptive wind noise masking filter.

FIG. 1 is a functional block diagram of a method and apparatus 10 for masking wind noise. An embodiment is implemented by a computer executing program instructions stored in a memory device coupled to the computer. The instructions cause the computer to perform functions identified by the various functional blocks. FIG. 1 thus illustrates a methodology, however, those of ordinary skill in the art will recognize that the methodology depicted in FIG. 1 can also be implemented using a digital signal processor (DSP), a field programmable gate array or FPGA as well as discrete devices. FIG. 1 is thus considered to also illustrate an apparatus.

An embodiment is comprised of a low-pass filter 15, which receives audio signals 30, such as those output from a conventional microphone 25. In the preferred embodiment, the low-pass filter 15 is a digital filter, embodied as various computer program routines that process digital representations of the audio signal 30 from the microphone 25.

As shown in the figure, the analog audio signals 30 are input to a Fast Fourier Transform (FFT) calculator 35, implemented using program instructions. The output of the FFT calculator is input to a multiplier 40, also implemented using program instructions. The multiplier 40 multiplies the output of the Fast Fourier Transform calculator 35 by the output of an adaptive wind noise masking filter 45.

The adaptive wind noise masking filter 45 receives information from a wind noise probability classification block 50 and processes appropriate reference filters 60 to generate a target filter to apply on the output of the FFT 35. The wind noise probability classification 50 generates an output that is indicative of whether the signal 30 from the microphone 25 is likely to have noise, speech, or combination of speech and noise. The wind noise probability classification is derived from information obtained from a wind noise detector 65.

Digital signals representing a wind noise-suppressed version of the audio from the microphone 25, is output from the multiplier 40 when a decision is made that the audio 30 from the microphone 25 is likely to have wind noise. The output of the adaptive wind noise masking filter 45 is therefore a frequency domain wind noise masking filter coefficients 58 which is input to the multiplier 40. The output of the multiplier 40 is input to an inverse Fast Fourier Transform (IFFT) circuit 70 the output of which 75 is a noise-reduced copy of the speech input into the microphone 25.

In an embodiment, wind noise detection is performed by a comparison of the low-pass filtered signal to the audio input signal 30. The comparison is computed as a ratio of the power level in each of the signals. In the embodiment, which uses the ratio of the low-pass filtered signal power $P_t$ to the total power of the input signal $P_T$, the comparison is a ratio expressed in equation (1) below. In the embodiment, low pass filter has a cutoff frequency at 150 Hz.

$$\rho(n) = \frac{P_t(n)}{P_T(n)} \tag{1}$$

Where, ρ is the power ratio for a given input frame, n. In an embodiment a frame is 10 ms long.

A wind noise probability classification (50) is calculated by using a "smoothened power ratio." The smoothened power ratio is expressed by equation (2) below:

$$\xi(n)=\alpha\cdot\xi(n-1)+(1-\alpha)\cdot\rho(n) \tag{2}$$

where, α is smoothing coefficient, the value of which is a design choice but selected to determine the emphasis to put on one or more historical values of ξ. And, the value of α is between 0 and 1. In an embodiment α is set in the rage of [0.75, 1), where the bracket "[" indicates inclusion of the adjacent value, i.e., the value next to it is to be included within the range and, the parenthesis means, up to but not including the adjacent value, i.e., the value "1" is not included in the range but all lesser values are.

In Equation (2), the value of ξ(n) defines the probability of speech or noise in the input signal. And, it can be seen in Equation (2) that the speech or noise probability determination uses a current sample represented by the term, $(1-\alpha)\cdot\rho(n)$ and at least one, previously-obtained sample or "history" of the signal, which is represented by the term. $\alpha\cdot\xi(n-1)$ In the embodiment, the following speech and noise classifications are obtained by comparing numeric values of ξ obtained from Equation (2) with user defined numeric thresholds:

$$\left.\begin{array}{l}\Psi = \text{“Speech only”: if } \xi < \text{SP_ONLY_THR} \\ \Psi = \text{“Mostly speech”: if SP_ONLY_THR} < \xi < \text{NS_SP_THR} \\ \Psi = \text{“Mostly wind noise”: if NS_SP_THR} < \xi < \text{NS_THR} \\ \Psi = \text{“Mostly noise only”: if NS_THR} < \xi\end{array}\right\} \quad (3)$$

where,

SP_ONLY_THR is a threshold for speech classification;
NS_SP_THR is an intermediate threshold for identifying high probability of speech or wind noise;
NS_THR is a high threshold for wind noise classification, and;
Ψ is a wind noise probability classification.

There could be more classifications of Ψ than are shown in the family of Equations (3), e.g., “More speech”, “More wind noise”, “Equal speech and wind noise” etc., in order to maintain smoother transition between wind noise and speech.

Figure 3:
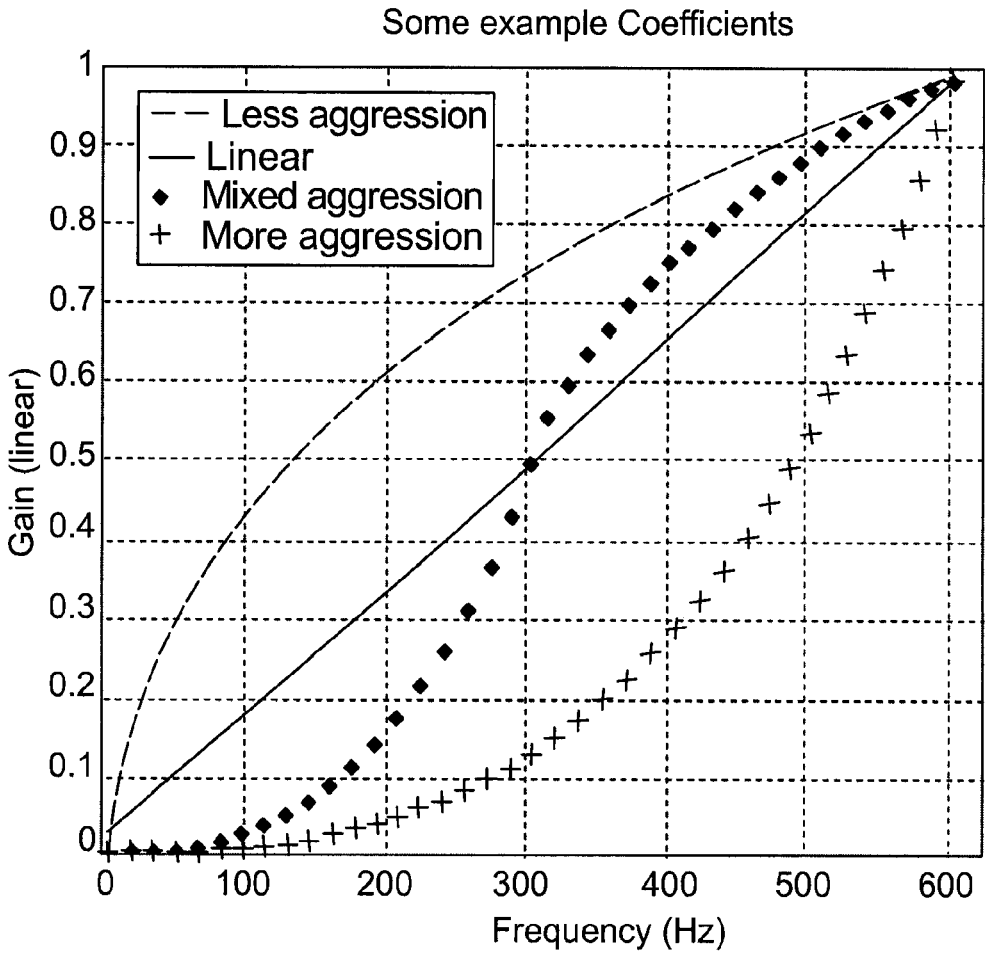
FIG. 3 shows several example frequency responses of primary noise masking filters.

The thresholds defined in the family of equations (3) are used to determine characteristics of a primary adaptive masking filter 45. The characteristics of a primary adaptive masking filter 45 are compared to at least one reference filter 60 and thereafter selected to allow appropriate suppression and/or amplification of noise and/or speech in the audio signal. Example frequency responses of reference filters 60 are shown in FIG. 3, where filter represented with ‘–’ performs less aggressive attenuation and filter represented with ‘+’ being more aggressive. The curves depicted in FIG. 3 depict examples of different attenuation characteristics of different reference filters. The solid line in FIG. 3 shows that one reference filter attenuates signals linearly from six hundred Hz. down to zero Hz. Stated another way, the solid line shows that one reference filter decreasingly attenuates input signals linearly from zero Hz. up to about six hundred Hz. The other curves show that other reference filters can have attenuation characteristics that are more or less aggressive in different frequency ranges.

The adaptive wind noise masking filter 45 derives a cogent (i.e., pertinent or relevant) frequency (CF) and a gain W for the CF determined by the evaluation of the wind noise probability classification Ψ received from the wind noise probability classification 50. In an embodiment, the CF and W of the filter 45 for the frame n are determined by the following family of equations (4):

$$W(n),\ CF(n) = \left\{\begin{array}{lll} G_{max}, & NsFreq & \text{if } \Psi = \text{Noise} \\ a \cdot G_{max}, & NsSpFreq & \text{if } \Psi = MostlyNoise \\ b \cdot G_{max}, & SpNsFreq & \text{if } \Psi = MostlySpeech \\ G_{min}, & SpFreq & \text{if } \Psi = \text{Speech} \end{array}\right\} \quad (4)$$

where, a and b are scaling parameters; and $0 \le b \le a \le 1$.
$G_{max}$ and $G_{min}$ are maximum attenuation and minimum attenuation applied to the signal respectively;
NsFreq, NsSpFreq, SpNsFreq and SpFreq are predetermined CFs for “Noise”, “Mostly noise”, “Mostly speech”, and “Speech” classifications respectively from the families of equations 3 set forth above.

Values of a, b, $G_{max}$, $G_{min}$, NsFreq, NsSpFreq, SpNsFreq and SpFreq are determined experimentally a priori, in order to optimize noise suppression from the input signal. After the cogent frequency (CF) and target gain (W) are determined from the family of equations (4) set forth above, an amplification factor or an attenuation factor $G_{low}$ and $G_{high}$ are calculated as shown in equation (5a) and (6a) respectively. The amplification or attenuation factor $G_{low}$ is applied to the frequencies below CF as shown in equation (5b) and $G_{high}$ is applied to the frequencies above CF as shown in equation (6b).

$$G_{low} = \frac{W(n)}{G(filt(CF))} \quad (5a)$$

$$filt(0:CF-1) = filt(0:CF-1) \cdot G_{low} \quad (5b)$$

Where, fill is a filter chosen from the reference filters 60;
filt(0:CF-1) are the filter coefficients of the chosen reference filter up to CF-1;
G(filt(CF)) is the current gain value on the chosen reference filter at CF;
$G_{low}$ is the calculated gain applied to the reference filter coefficients below CF as shown in equation (5b).
And, $$G_{high} = \frac{1 - W(n)}{G(filt(FiltLen)) - G(filt(CF))} \quad (6a)$$

$$Filt(CF:FiltLen) = (filt(CF:FiltLen) - G(filt(CF))) \cdot G_{high} \quad (6b)$$

Where, filt(CF:FiltLen) are the filter coefficients of the reference filter from CF to the last frequency (FiltLen) of the filter;
G(filt(FiltLen)) and G(filt(CF)) are the current gains of the reference filter coefficients at the last frequency (FiltLen) of the reference filter and at the CF respectively;
$G_{high}$ is the calculated new gain applied to the normalized filter coefficients of the reference filter (filt) above CF as shown in equation (6b).

Adjusting the CF of the filter 45 based on $G_{low}$ and $G_{high}$ in response to historical characteristics of noise in a signal effectively changes the shape of the pass band of the filter 45, in real time, in response to changing noise levels in the signal 30 from the microphone 25 audio source. The shape of the band pass characteristic of the filter 45 is therefore adjusted empirically in real time, i.e., based on observations of noise characteristics, such that the filter 45 attenuates noise signals on the input signal 30 by reducing the amplitude of the signals in a particular frequency spectrum range that are received from the Fast Fourier Transform calculator 35. Stated another way, the adaptive wind noise masking filter 45 generates filter coefficients to selectively attenuate different frequency ranges to suppress wind noise content in signals received from the Fast Fourier Transform calculator 35. The adaptive wind noise-masking filter 45 therefore effectively extracts speech signals from the input signal 30. Different frequency ranges are attenuated by determining coefficients of the FFT calculator output.

A slow moving average based on a history of both W and CF is calculated for smoother transition between speech and noise part of the input signal. For W, the slow moving average can be expressed as:

$$\hat{W}(n) = \beta \cdot W(n \cdot 1) + (1-\beta) \cdot W(n) \quad (7)$$

Where, β is a smoothing coefficient between 0 and 1. In an embodiment, the value of β is set in the rage of [0.75, 1). Smoothening of the filter coefficients for CF is calculated as shown in Equation (9) below.

Figure 4:
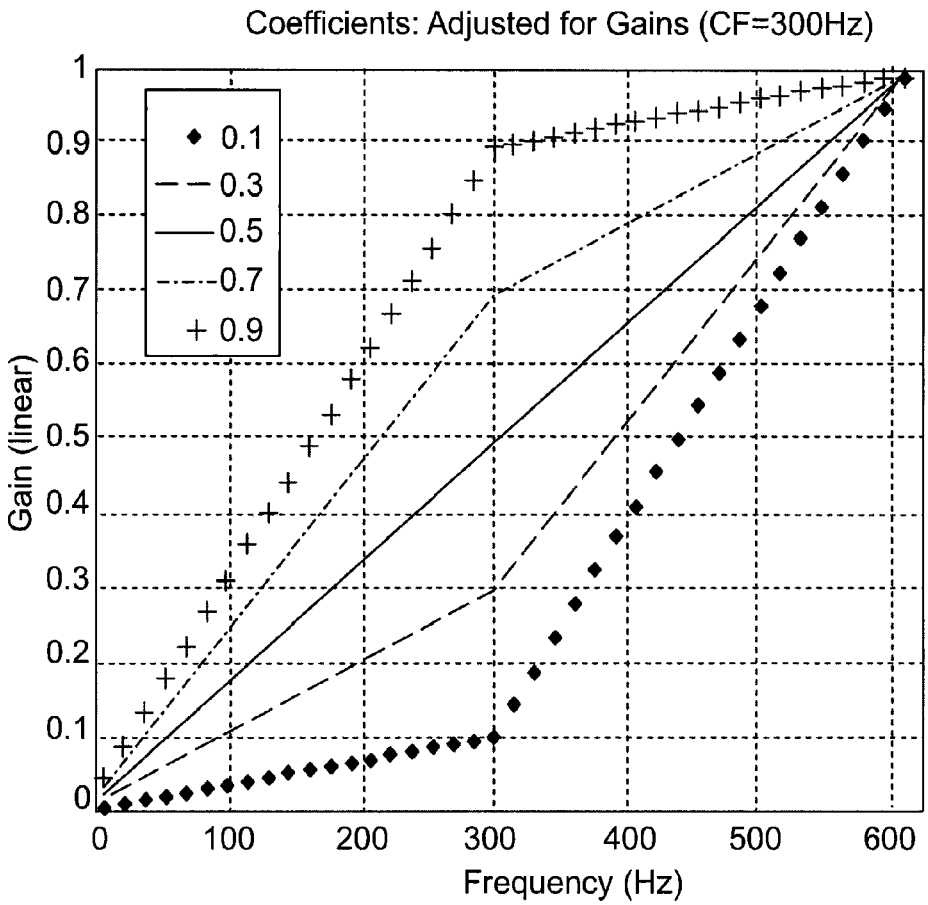
FIG. 4 shows frequency response changes for linear primary noise masking filter gain (W) variation from 0.1 to 0.9 at a fixed Cogent frequency (CF)
Figure 5:
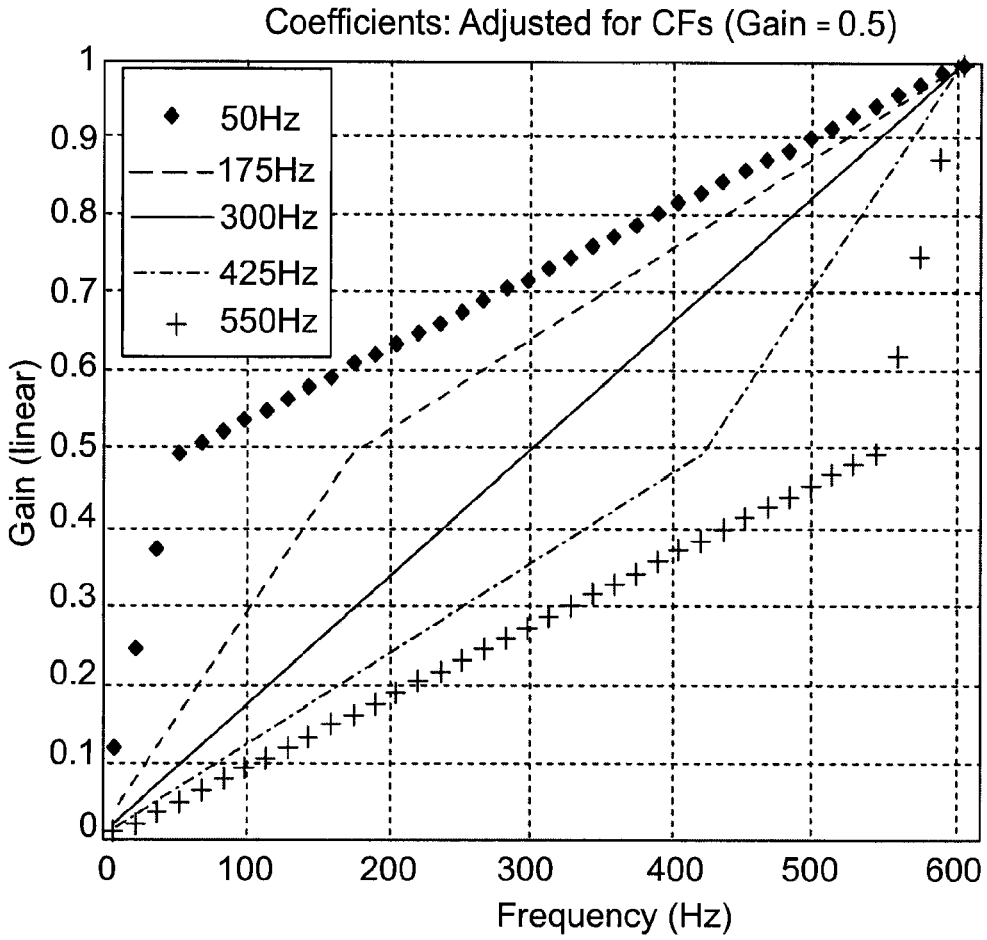
FIG. 5 shows frequency response changes for linear primary noise masking filter CF variation from 50 Hz to 550 Hz. At a fixed gain W.
Figure 6:
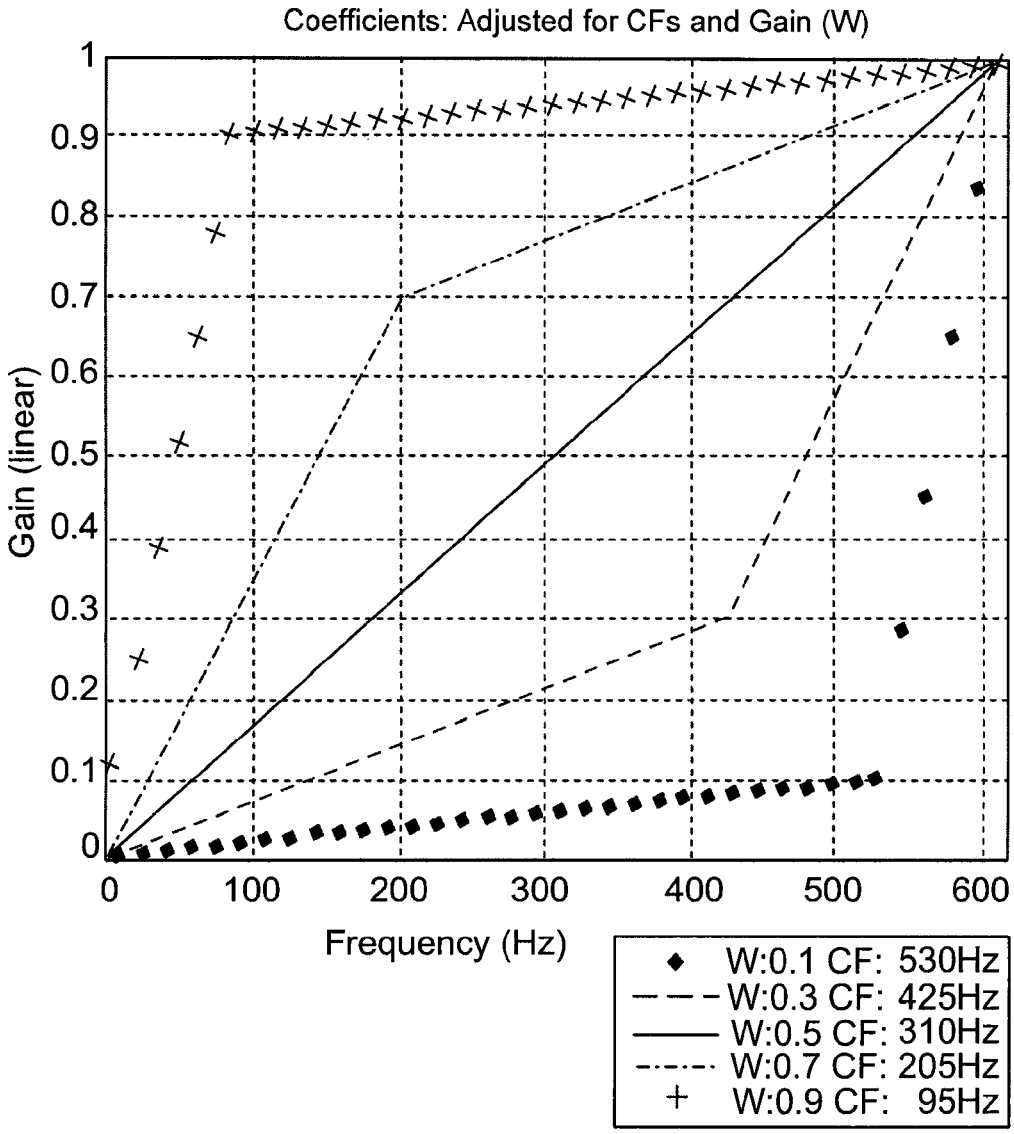
FIG. 6 shows frequency response changes for a linear reference filter based on different W and CF.

FIG. 4 shows examples of different filter coefficients where CF remains constant at 300 Hz. and the gain W changes linearly from 0.1 to 0.9. FIG. 5 shows different values of CF with a value of W equal to 0.5 and CF changes between 50 Hz. to 550 Hz. Together, FIG. 4 and FIG. 5 show the changes in W and CF based on a linear reference filter, however an actual reference filter could be of any shape and length. FIG. 6 shows the linear reference filter change based on different W and CF.

Significantly, the reference filter 60 can be of different frequency ranges and different shapes for different values of Ψ. This helps adapt the adaptive wind noise masking filter 45 to different noise characteristics in real time, based on actual noise conditions in the actual environment where the filter 45 is being used. There can also be more than one gain Was well as more than one CF in order to be able to achieve a smooth filter response, i.e., one with multiple filter steps.

Equation (8) below is a wind noise masking filter response to be applied on the input signal in frequency domain. The function Adaptive Win is a function that generates the wind noise masking filter based on the values of CF, $\hat{W}$ and filt reference filter as shown in Equations (5) and (6) above.

$$Wnm(\omega)=\text{AdaptiveWin}(CF,\hat{W},\text{filt}) \tag{8}$$

where, Wnm represents wind noise masking filter.

Once the wind noise masking filter coefficients are determined, averaging is performed on each coefficient of the new filter shaped for smooth changes in CF. This helps improve the sound quality and makes it pleasant to hear when transitioning between speech and noise.

$$\hat{W}nm(n)=\delta\cdot Wnm(n-1)+(1-\delta)\cdot Wnm(n) \tag{9}$$

Where δ is a smoothing coefficient between 0 and 1. In an embodiment, the value of δ is set in the rage of [0.75, 1).

In Equation (9), the value of δ is selected to provide different ramp rates between speech-to-noise and noise-to-speech transitions and to be able to adapt more quickly or less quickly from one condition to the other. δ can thus be considered to be a ramp rate, which is a rate at which a speech-to-noise and noise-to-speech transition is made. Masking the noise in the adaptive wind noise masking filter 45 is a simple multiplication 40 of the filter coefficients 58 and input samples received from the FFT calculator 35. That multiplication can be expressed as:

$$\hat{X}(w)=Wnm(w)\cdot X(\omega) \tag{10}$$

where $$X(\omega)=\text{FFT}(x(n)) \tag{11}$$

and where $\hat{X}$ is a wind noise suppressed signal in the frequency domain, and ω represents a specific frequency.

A noise-suppressed audio output signal 75 is obtained by computing an inverse Fourier Transform (IFFT) 70 on signals output from the adaptive wind noise masking filter 45, via the multiplier 40. The IFFT output 75 can be expressed as:

$$\bar{x}(n)=\text{IFFT}(\hat{X}(\omega)) \tag{12}$$

Where, $\bar{x}$ is the wind noise suppressed final output 75 for frame n in the time domain.

The system depicted in FIG. 1 effectively masks wind noise in audio signals by classifying certain low frequency signals as being wind noise and signals above a particular frequency as being speech and using a recent history of noise characteristics in the signal. The system 10 adapts the noise filtering based on a recent history of input signals 30 (at least one previous sample) to keep the characteristics of the filter 45 changing over time. Tracking the noise characteristics over time helps mask wind noise bursts known as buffeting and enables the system 10 to adapt to different acoustic environments that include, but are not limited to, hands-free microphones, conference rooms or other environments where background noise would otherwise be detectable in an audio signal detected by a microphone.

Figure 2:
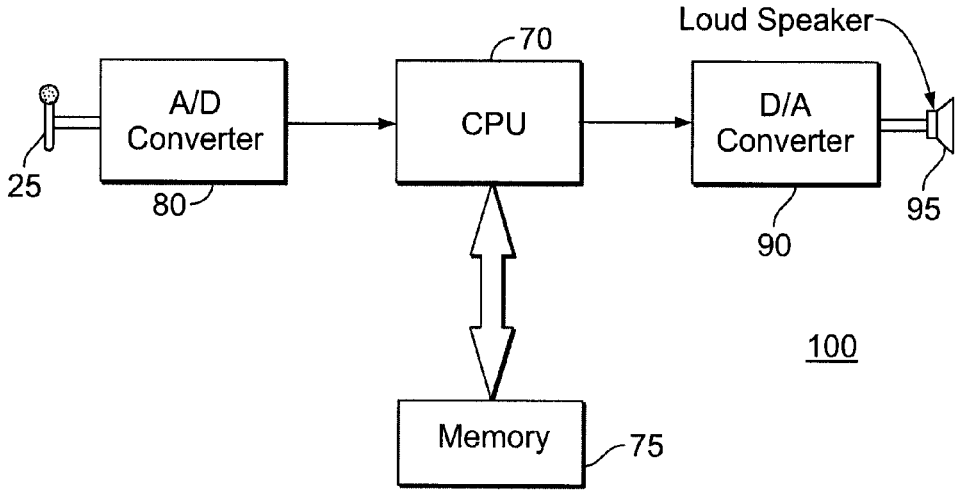
FIG. 2 depicts a block diagram of an implementation of the adaptive wind noise masking filter using a computer.

FIG. 2 is a block diagram of an audio system 100 that forms part of a radio. An embodiment includes a computer, i.e., a central processing unit (CPU) 70 having associated memory 75 that stores program instructions for the CPU 70. Analog output signals from the microphone 25 are converted to a digital form by an analog to digital (A/D) converter 80. The digital signal from the A/D converter 80 is input to and processed by the CPU 70 using the methodology described above. The memory device 75 stores program instructions, which when executed by the CPU 70, cause the CPU 70 to perform the steps described above, including changing characteristics of the adaptive wind noise masking filter according to the detected noise content in an input signal 30. The CPU 70 outputs a digital representation of the corrected digital sound signal to a digital to analog (D/A) converter 90. The analog signal from the D/A converter 90 is input to a loudspeaker 95. An example of the output signal quality improvement is shown in FIGS. 7A and 7B.

Figure 7A:
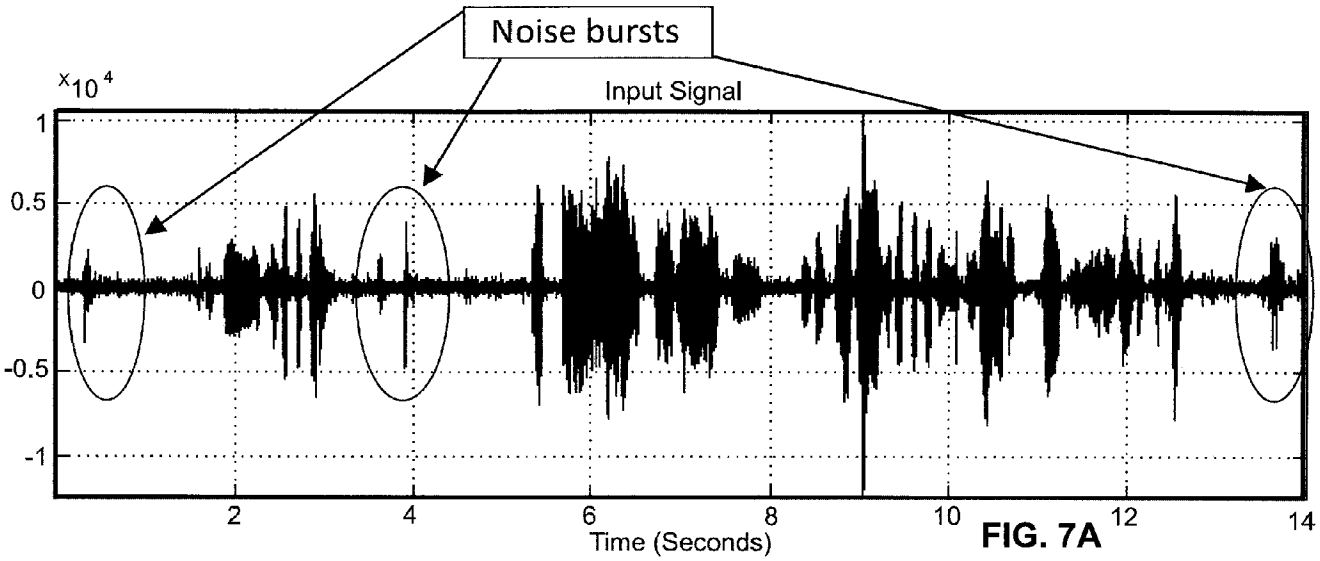
FIGS. 7A and 7B show oscilloscope traces of an input signal before and after filtering the audio signal using the adaptive wind noise masking filter.

FIG. 7A is an oscilloscope trace of an actual audio signal that is input to the adaptive wind noise filter described above. FIG. 7B is an oscilloscope trace of the same signal after it has passed through, i.e., after it has been processed by, the adaptive wind noise filter. Short-duration noise bursts in the input signal shown in FIG. 7A are removed from the output signal shown in FIG. 7B. The output signal is otherwise the same or substantially the same as the input signal.

Figure 7B:
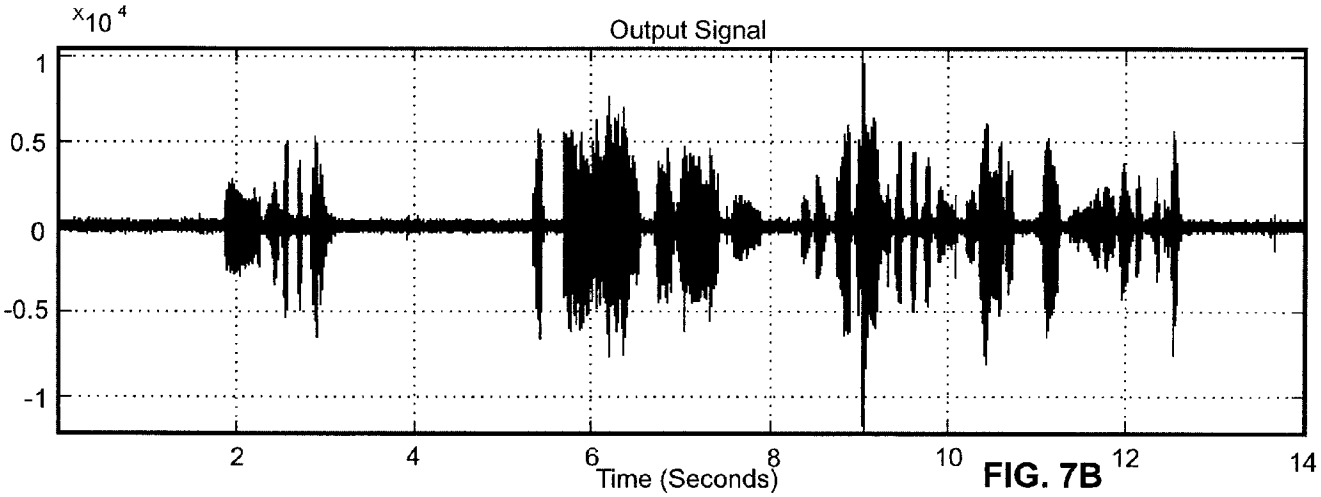
Figure 8:
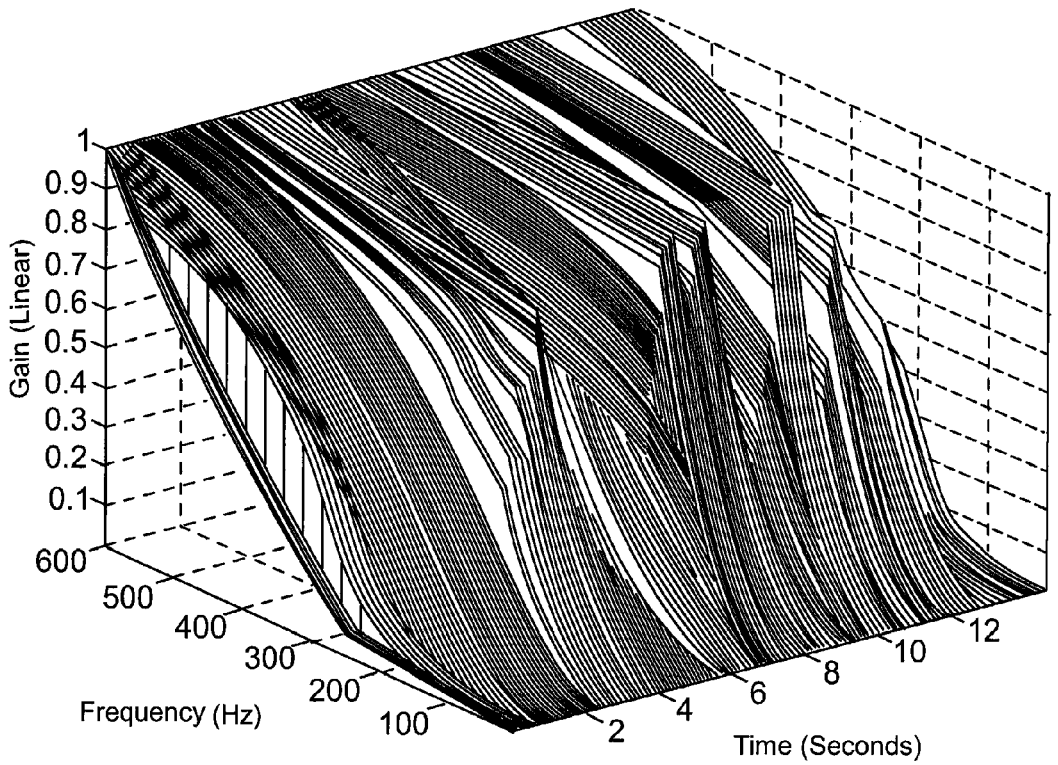
FIG. 8 is a depiction of how characteristics of the adaptive wind noise masking filter change over time, to provide the output signal shown in FIG. 7B from the input signal shown in FIG. 7A.

FIG. 8 shows how characteristics of the adaptive wind noise masking filter change over time, to provide the output signal shown in FIG. 7B from the input signal shown in FIG. 7A. The filter's gain or attenuation is depicted as a vertically-oriented axis, which is orthogonal to two other, mutually orthogonal axes that are labeled "Frequency" and "Seconds."

In FIG. 7A, the first or left-most noise burst is missing from the output signal shown in FIG. 7B. That first noise burst is suppressed, by adjusting the gain of the filter to suppress the burst.

As shown in FIG. 8, input signal frequencies below about 300 Hz. are attenuated, i.e., have zero gain, just after the initial or starting time shown in the figure. The gain provided to input signals above 300 Hz. however increases linearly.

In FIG. 7A, there is a second noise burst at t=4 seconds. That second noise burse is missing from the output signal shown in FIG. 7B. The second noise burst at t=4 seconds is suppressed, by adjusting the gain of the filter to suppress the second noise burst.

In FIG. 8, at t=4 seconds, input signal frequencies below about 300 Hz. are attenuated, i.e., have little or no gain provided to them whereas the low frequency filter gain just prior to and just after t=4 seconds is greater. Reducing or eliminating the amplification of low frequency signals around 4 seconds thus suppresses the noise burst as shown in FIG. 7B.

The last or right-most noise burst shown in FIG. 7A is also missing from the output as shown in FIG. 7B. In FIG. 8, the filter's gain at t=12 is shown as being reduced. The reduced gain at t=12 seconds suppresses the noise burst from the output signal shown in FIG. 7B.

In a preferred embodiment, filter characteristics were chosen to suppress relatively low-frequency signals, i.e., below about 300 Hz, and having relatively short durations, i.e., less than a few hundred milliseconds. Such signals are typically produced by wind gusts passing a microphone. Different filter characteristics can be chosen to suppress signals with different frequencies and different durations. The method and apparatus disclosed herein should therefore not be considered to be limited to filtering only wind noise. By appropriately selecting operating characteristics, the adaptive filter can suppress or amplify high-frequency electrical noise caused by electric arcing, such as spark plug ignition noise. The filter can also be used to suppress or amplify signals within a frequency band.

While a preferred embodiment of the filter attenuates signals, the filter disclosed herein can also apply selective amplification to signals at different frequencies or within user-specified pass bands. Selectively amplifying signals in pass bands can be applied to radar, sonar and two-way radio communications systems.

Those of ordinary skill in the art will appreciate that in an alternate embodiment, the low-pass filtering can instead be a band-pass filter whereby frequency spectrum segments are selectively filtered with the result being a determination of whether noise is present. An example of a band-pass filter would be one that selectively filters audio signals between approximately 100 Hz up to about 300 to 400 Hz.

In an embodiment, the following threshold values were used:

a. From families of equation (3) SP_ONLY_THR=0.3; NS_SP_THR=0.5 and NS_THR=0.7.

b. From families of equation (4) a=0.6, b=0.3, $G_{max}$=−30 dB, $G_{min}$=0 dB, NsFreq=300 Hz, NsSpFreq=250 Hz, SpNsFreq=200 Hz and SpFreq=150 Hz.

In an alternate embodiment, the filtering performed by the low-pass filter 15 or some other filter device is performed by analog circuitry, well-known to those of ordinary skill in the electronic arts. Such filters can be either passive or active.

The wind noise detection circuit 65 can alternatively be implemented using operational amplifiers to compute either a difference or ratio between the power levels of the signal from the filter 15 to the input signal 30. Similarly, the wind noise probability classification 50 can also be implemented using analogue operational amplifiers to output signals to an array of active filters that make-up an analogue version of the adaptive wind noise masking filter 45.

In an analog device environment, the Fast Fourier Transform calculator 35 can be replaced by an array of frequency-selective active filters each of which is configured to selectively amplify segments of the spectrum of the input signal 30.

The foregoing description is for purposes of illustration only. The true scope of the invention is set forth in the appurtenant claims.

What is claimed is:

1. A method of suppressing wind noise in an audio signal obtained from a microphone, the method comprising:

receiving audio frequency signals at a low pass filter, the audio frequency signals being received by the low pass filter from a microphone, said audio frequency signals comprising at least one of: noise, speech and a combination of noise and speech;

generating a wind noise probability by calculating a smoothened power ratio based on a ratio of signals output from the low pass filter to the audio frequency signals received from the microphone, wherein the smoothened power ratio represents a wind noise probability;

selecting a reference filter from a plurality of reference filters based on the wind noise probability;

selecting a cogent frequency of an adaptive filter coupled to the microphone and changing an attenuation of the adaptive filter at the selected cogent frequency, the adaptive filter cogent frequency being selected from a plurality of frequencies using at least one characteristic of the selected reference filter, the selecting of a cogent frequency of the adaptive filter and the changing of the attenuation of the adaptive filter being made responsive to evaluation of the wind noise probability, thereby changing a pass band characteristic of the adaptive filter;

generating and outputting different filter coefficients from the adaptive filter responsive to different wind noise probabilities; and multiplying digital representations of audio frequency signals from the microphone by filter coefficients of the adaptive filter to produce a noise-reduced output signal;

wherein the steps of: generating a wind noise probability, selecting a reference filter, selecting a cogent frequency of an adaptive filter, changing an attenuation of an adaptive filter, generating and outputting filter coefficients and multiplying digital representations of audio frequency signals from the microphone by coefficients of the adaptive filter, are performed continuously to continuously change a shape of the adaptive filter's pass band responsive to changing characteristics of wind noise in the audio frequency signals.

2. The method of claim 1, wherein the step of multiplying digital representations of audio frequency signals from the microphone by coefficients of the adaptive filter to produce a noise-reduced output signal, is not performed when noise is not present in the audio frequency signals received by the filter from the microphone.

3. The method of claim 1, wherein the step of generating a wind noise probability is further comprised of:

filtering the input signal to provide a filtered portion of the signal; and comparing a relationship between the input signal and the filtered portion of the signal to a plurality of threshold values.

4. The method of claim 1, wherein the wind noise probability is identified based on comparison with thresholds.

5. The method of claim 4, wherein the value of each threshold of the plurality of thresholds is predetermined.

6. The method of claim 1, wherein each filter of the plurality of reference filters optionally has one or more corresponding cogent frequencies and one or more corresponding attenuations.

7. The method of claim 1, further comprising the step of smoothening the one or more corresponding gains of each reference filter.

8. The method of claim 7, further comprising the step of using different values for a smoothing coefficient to calculate a smoothened gain of each filter of the plurality of filters based on at least one type of a wind noise-probability transition selected from:

a speech-to-noise transition; and a noise-to-speech transition.

9. The method of claim 6, further comprising the step of smoothening a frequency response of each reference filter.

10. The method of claim 6, further comprising the step of using different smoothing coefficients to calculate a smoothened cogent frequency of each filter of the plurality of filters based on at least one type of a wind noise-probability transition selected from:

a speech-to-noise transition; and a noise-to-speech transition.

11. The method of claim 10, further comprising the step of selecting a plurality of cogent frequencies for a corresponding number of reference filters.

12. The method of claim 1, further comprising the step of modifying a frequency response of the reference filters based on a selected attenuation.

13. The method of claim 1, further comprising the step of modifying a frequency response of the reference filters based on one or more attenuations and one or more cogent frequencies.

14. The method of claim 1, further comprising the step of: separately modifying a frequency response above and below a cogent frequency based on a selected gain.

15. An apparatus comprising:

a microphone;

an analog-to-digital converter receiving audio signals from the microphone and providing digital signals representing said audio signals;

a processor configured to receive digital signals representing audio signals obtained from the microphone; and a memory device coupled to the processor, the memory device storing program instructions, which when executed by the processor cause the processor to:

generate a wind noise probability by calculating a smoothened power ratio using the digital signals representing the audio signals obtained from the microphone and a low pass filtered version of the digital signal;

adaptively filter microphone signals by:

selecting a reference filter based at least in part on the wind noise probability; and selecting a cogent filter frequency and changing an attenuation at the selected cogent filter frequency responsive to changing wind noise levels in the audio frequency signals from the microphone and responsive to characteristics of the selected reference filter, thereby changing a pass band filter characteristic responsive to wind noise in the audio frequency signals from the microphone;

generate filter coefficients responsive to different wind noise probabilities; and multiply digital representations of audio frequency signals from the microphone by filter coefficients to produce a wind-noise-reduced output signal;

wherein, the selecting a reference filter, selecting a cogent frequency, changing an attenuation at the selected cogent frequency, generating filter coefficients and multiplying digital representations of audio frequency signals by filter coefficients, are performed continuously to continuously change a pass band filter characteristic responsive to wind noise in the audio frequency signals from the microphone.

16. The apparatus of claim 15, wherein the memory device stores program instructions, which when executed by the processor cause the processor to: provide a reference filter based on the wind noise probability, wherein the selected reference filter is configured to selectively attenuate signals in a range of frequencies of the wind noise, attenuated signals comprising wind noise signals.

17. The apparatus of claim 15, further comprising a memory device having program instructions, which when executed by the processor cause the processor to omit the step of, multiplying digital representations of audio frequency signals from the microphone by coefficients of the adaptive filter to produce a noise-reduced output signal, when wind noise is not present in the audio frequency signals received by the filter.

18. The apparatus of claim 15, further comprising a memory device having program instructions, which when executed, cause the processor to generate a wind noise probability, which is further comprised of:

filtering the input signal to provide a filtered portion of the signal; and comparing a relationship between the input signal and the filtered portion of the signal to a plurality of threshold values.

19. The apparatus of claim 15, further comprising a memory device having program instructions, which when executed, cause the processor to classify a wind noise probability based on a comparison with thresholds.

20. The apparatus of claim 15, further comprising a memory device having program instructions, which when executed cause the processor to classify a wind noise probability based on a comparison of predetermined thresholds.

21. The apparatus of claim 15, further comprising a memory device having program instructions, which when executed cause the processor to select the reference filter from a plurality of reference filters, each filter attenuating signals in a range of frequencies differently.

22. The apparatus of claim 21, wherein each reference filter has at least one cogent frequency.

23. The apparatus of claim 22, wherein each reference filter has a predetermined frequency response above and below the reference filter's cogent frequency based on a selected gain.

24. A signal filter apparatus comprising:

a microphone, which detects sound and which outputs electrical signals representing detected sound;

a low pass filter that receives from the microphone, electrical signals corresponding to detected sound and which produces an output signal representing electrical signals from the microphone that are low-pass filtered;

a wind noise detector, configured to receive the signals from the low pass filter and to receive the electrical signals from the microphone, the wind noise detector configured to compute a ratio between a power level of the signals from the low pass filter and electrical output signals from the microphone;

a wind noise probability classifier, receiving indications of wind noise from the wind noise detector and outputting a signal indicating whether the signal detected by the microphone is at least one of: noise; speech and a combination of speech and noise;

an adaptive wind noise masking filter having at least one cogent frequency and providing an attenuation at the cogent frequency, the adaptive wind noise masking filter cogent frequency and attenuation being selected using a reference filter's characteristics and wind noise classifications from the wind noise classifier, the adaptive wind noise masking filter being configured to change the at least one cogent frequency and change attenuation of the adaptive wind noise masking filter at the cogent frequency responsive to evaluation of the indications of wind noise in the input signal, the changing of the at least one cogent frequency and attenuation changing a band pass characteristic of the adaptive wind noise masking filter;

a fast Fourier transform (FFT) calculator configured to provide FFT representations of the input signal; and a multiplier, configured to provide a multiplication of FFT representations of the input signal by coefficients of the adaptive wind nose masking filter and to produce a noise-reduced output signal by said multiplication;

wherein the filter apparatus is configured to continuously:

generate a wind noise probability;

select a reference filter;

select a cogent frequency of an adaptive filter;

change an attenuation of an adaptive filter; and multiply digital representations of audio frequency signals from the microphone by coefficients of the adaptive filter, to thereby continuously change a shape of the adaptive filter's pass band responsive to changing characteristics of wind noise in audio signals received at the microphone.

25. The signal filter apparatus of claim 24, further comprising a plurality of reference filters coupled to the adaptive wind noise masking filter, each reference filter of the plurality of reference filters having different signal filtering characteristics, the signal filtering characteristics of a selected one of the reference filters being provided to the adaptive wind noise masking filter.

26. The signal filter apparatus of claim 24, wherein said apparatus is configured to adaptively suppress wind noise at differing frequencies and differing amplitudes from an audio signal responsive to evaluation of wind noise indications received from the wind noise detector.

* * * * *